US008356369B2

(12) United States Patent
Bonatz

(10) Patent No.: US 8,356,369 B2
(45) Date of Patent: Jan. 22, 2013

(54) DISC AND ELONGATE SUPPORT PORTABLE BED ASSEMBLY

(75) Inventor: Richard Bonatz, Duluth, GA (US)

(73) Assignee: Disc-O-Bed Holdings Limited (CY)

( * ) Notice: Subject to any disclaimer, the term of this patent is extended or adjusted under 35 U.S.C. 154(b) by 58 days.

(21) Appl. No.: 12/853,553

(22) Filed: Aug. 10, 2010

(65) Prior Publication Data

US 2010/0319123 A1 Dec. 23, 2010

Related U.S. Application Data

(60) Continuation-in-part of application No. 12/197,384, filed on Aug. 25, 2008, now Pat. No. 7,797,772, and a division of application No. 12/777,536, filed on May 11, 2010, now Pat. No. 7,921,483.

(51) Int. Cl.
*A47C 17/64* (2006.01)

(52) U.S. Cl. ..... 5/114; 5/110; 5/111; 5/9.1; 403/206

(58) Field of Classification Search ..... 5/9.1, 8, 5/110, 112, 282.1, 114, 626, 620; 403/206
See application file for complete search history.

(56) References Cited

U.S. PATENT DOCUMENTS

| | | | | |
|---|---|---|---|---|
| 708,869 | A | 9/1902 | Davidoff | |
| 3,426,367 | A * | 2/1969 | Bradford | 5/626 |
| 4,928,333 | A | 5/1990 | Ewert | |
| 5,279,387 | A | 1/1994 | Swiderski et al. | |
| 5,483,707 | A | 1/1996 | Meyer et al. | |
| 6,938,288 | B2 | 9/2005 | Hunter et al. | |
| 7,805,786 | B2 * | 10/2010 | Lambarth | 5/620 |
| 7,856,683 | B2 * | 12/2010 | Zheng | 5/111 |
| 2007/0012346 | A1 * | 1/2007 | Choi | 135/114 |

* cited by examiner

*Primary Examiner* — Robert G Santos
*Assistant Examiner* — Brittany Wilson
(74) *Attorney, Agent, or Firm* — Lackenbach Siegel LLP

(57) ABSTRACT

A portable bed assembly of a disc and an elongate support, and the disc has a body having a central hole having an axis, and the central hole being sized for slidably receiving the elongate support, with the disc body and the elongate support having a cooperable flexibly mounted retractably extendable lock pin and the disc body has two transversely disposed through holes for receiving the lock pin and locking the elongate support in the disc body and preventing rotational movement of the elongate support in the disc body.

15 Claims, 20 Drawing Sheets

DISC AND ELONGATE SUPPORT PORTABLE BED ASSEMBLY

PRIOR RELATED APPLICATIONS

This application is a continuation-in-part of patent application Ser. No. 12/197,384, filed Aug. 25, 2008, now U.S. Pat. 7,797,772, granted Sep. 21, 2010, and also claims priority to divisional patent application Ser. No. 12/777,536, filed May 11, 2010 now U.S. Pat. No. 7,921,483, and incorporates these priority applications herein in their entireties by reference thereto.

BACKGROUND OF THE INVENTION

1. Field of Use of the Invention

This invention relates to a portable bed assembly. This invention also relates to components for a bed assembly particularly including a disc and elongate support. This invention further relates to a portable assembly for a double-decker bed having a disc and elongate support construction.

2. Background and Discussion of the Prior Art

A collapsible bed is disclosed in U.S. Pat. No. 4,928,833, issued May 29, 1990 to Bonatz, which patent disclosure is incorporated herein in its entirety by reference thereto (the "Bonatz prior art construction"). The Bonatz prior art single bed construction included tubular frame members, a canvas bed and discs which when assembled formed a single bed. The Bonatz prior art construction was only operable as and suitable for a single bed function. Further, the Bonatz prior art construction components were difficult to transport.

It is a principal object of the present invention to provide improved functionality for a portable bed assembly component.

It is another principal object of the present invention to provide an improved lock construction for inter-locking portable bed assembly components.

It is a further principal object of the present invention to provide an assembly for a double-decker bed or alternatively two single beds.

It is another object of the present invention to provide lockable portable bed support components for the assembly of the aforesaid beds.

It is a further object of the present invention to provide a kit including carry bags for the ready transport of the components for the alternate assembly of a double-decker bed or two single beds.

The foregoing objects are achieved by the present invention.

SUMMARY OF THE INVENTION

The present invention, in one embodiment, is a kit for the storage and transport of a bed assembly. The kit includes two carry bags with cooperable construction components in each bag, which components when assembled provide a double-decker bed or alternatively two single beds. The kit includes flexible material construction foot lockers for the ready assembly and disposition under the double-decker bed or separately under each single bed. The foot lockers are folded to a flat storage disposition. The construction components include novel heavy duty assembly discs and cooperable connectable tubular frame members. The head and foot assembly discs and tubular frame member constructions are pre-assembled and stowed as a kit in respective carry bags. The heavy duty discs have asymmetrically disposed reinforcing ribs in a specific disposition with respect to the connected tubular frame members. The double-decker bed has two unfolded foot lockers disposed beneath the lower bed and an accessories pouch removably attached to and depending from the lower bed frame. The carry bags with the bed assembly components stowed therein are readily carried from one location to another for ready assembly of the double-decker bed or two single beds. The present kit construction and bed assembly is particularly useful in, but not limited to, military applications.

The present invention, in a second embodiment, is a portable bed disc, and portable bed assembly including an elongate portable bed support. The disc has a body having a central hole, and the elongate support has cooperable means for locking the elongate support in the disc body. The means for locking includes an extendably retractable lock pin operably disposed on the elongate support. The retracted lock pin is aligned with a transversely disposed hole in the disc body, with the one end of elongated support slidably disposed inside the disc body central hole. The lock pin is radially outwardly disposed in the transversely disposed hole so as to lock the elongate support in the disc body.

The present invention, in a further embodiment is a disc which alternately locks a first elongate support in a rotatable locking action and locks a second elongate support in a non-rotatable locking action as immediately afore-described.

The invention is a further embodiment in a swaged elongate support in combination with a non-rotatable locking action in the disc body with improved guidance and quick positive locking action.

DESCRIPTION OF THE INVENTION

Figure 1:
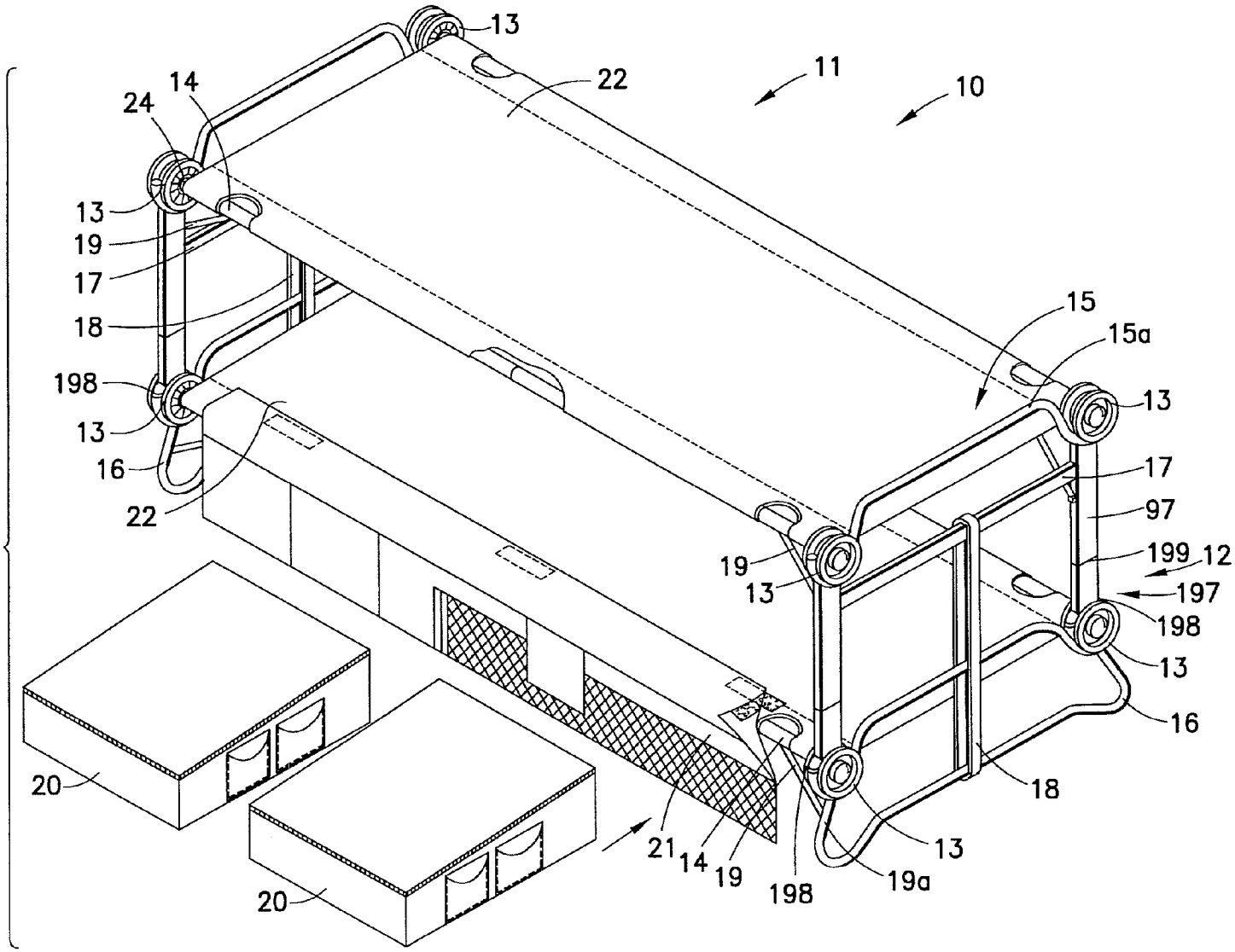
FIG. 1 is a front perspective partial assembly view of the double-decker bed of the present invention.

Referring to FIG. 1, there is shown the double-decker bed or bed assembly 10 of the present invention. Bed 10 includes an upper bed or cot 11 and a lower bed or cot 12. The bed construction in general includes eight assembly discs 13, four tubular assembly side members or assemblies 14, two upper bed tubular head assembly 15, has lower bed head and foot assemblies 16, two horizontally disposed cross members or supports 17, two vertically disposed integrating connecting straps 18, four angularly disposed reinforcing struts 19, and two canvas or like flexible material bed support pieces 22. A pair of foot lockers 20 and a hanging accessories pouch 21, in general, completes the double-decker bed assembly 10, as will be more fully discussed hereinafter.

Figure 2:
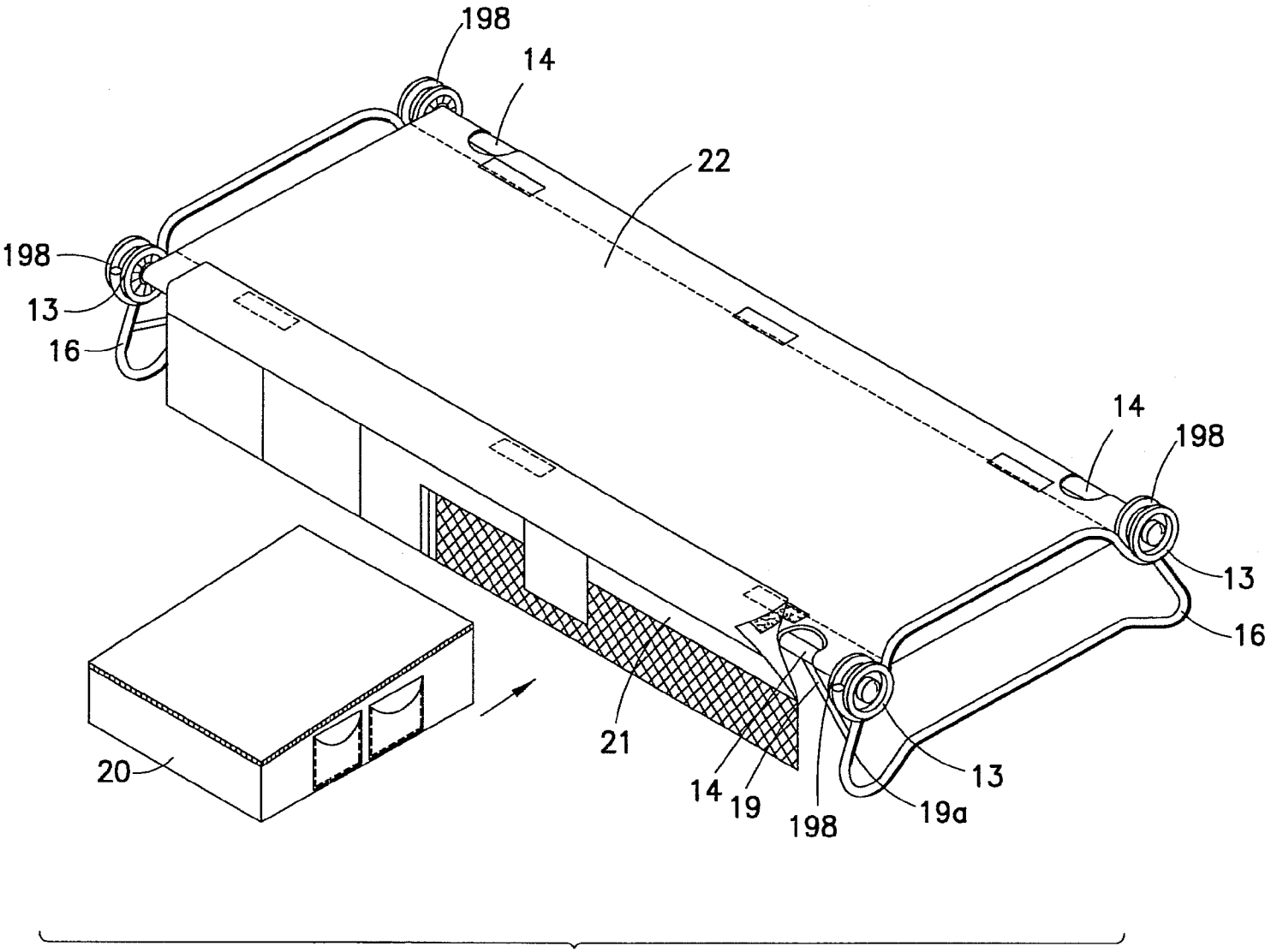
FIG. 2 is a front perspective partial assembly view of the single lower bed.

Referring to FIG. 2, there is shown the lower bed or cot 12 in the single bed disposition. Bed 12 has four assembly discs 13 and two tubular foot assemblies 16 and two tubular frame assemblies 14 interconnected with canvas support piece 22 to in general from the assembled single lower bed 12. One foot locker 20 is slidably disposed under the bed. Accessories pouch 21 is Velcro® attached to the flexible cover 22 portion surrounding tubular frame assembly 14.

Figure 3:
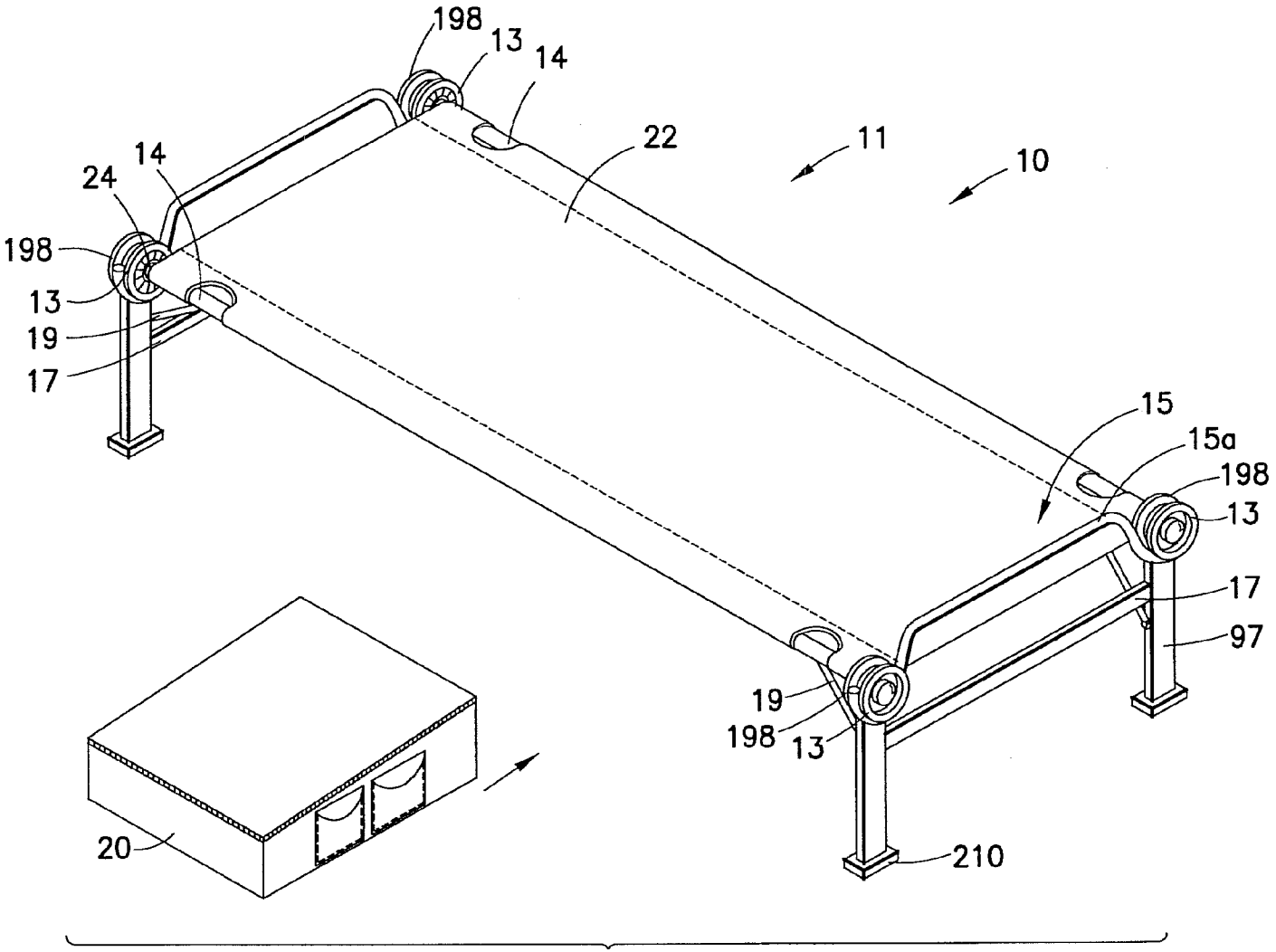
FIG. 3 is a front perspective partial assembly view of the single upper bed.

Referring to FIG. 3, there is shown upper bed or cot 11 in the single bed disposition. Bed 11 has four assembly discs 13, two tubular assemblies 15, two tubular frame assemblies 14 with canvas support piece 22 to in general form the assembled single (upper) bed 11. Tubular assemblies 15 include lock cylindrical tubular members 15*a* and conjoined rectilinear tubular members 17 and 97. One foot locker 20 is slidably disposed under the bed. Foot pads 210 cap the rectilinear ends of vertically disposed tubular members 97.

Referring again to FIG. 1, lower support member 197 inter-fittingly engages depending tubular frame member 97 as at 199. Lower support members also include depending semi-circular tubular end piece 198 which slidably inter-fits within the annular circumferential recess or track of lower disc 13. Integrating or locking strap 18 surrounds bottom tubular frame member 78 and upper tubular frame member 15*a* and the tighten strap 18 provides a locking tension force between lower assembly 16 and upper assembly 15.

Figure 12:
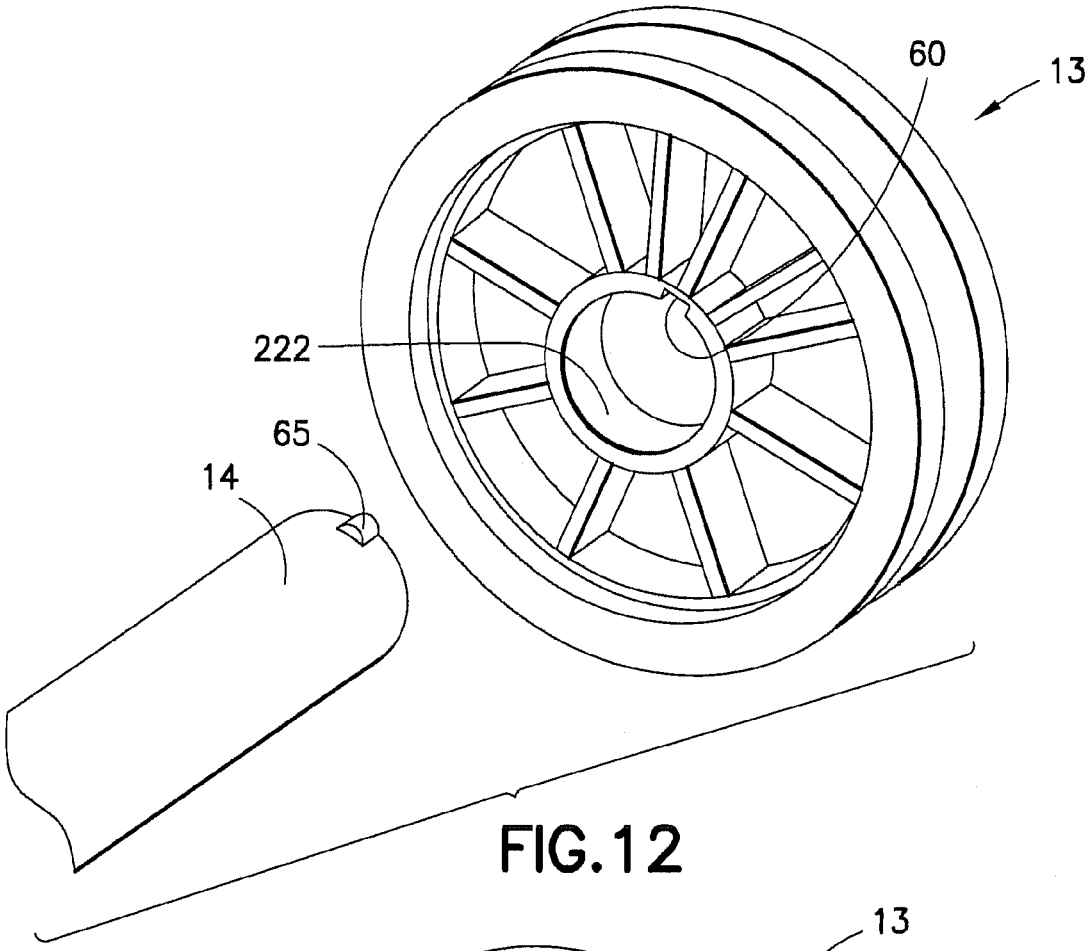
FIG. 12 is a perspective view of the assembly disc of FIG. 9 and a tubular frame member in the unassembled position.
Figure 13:
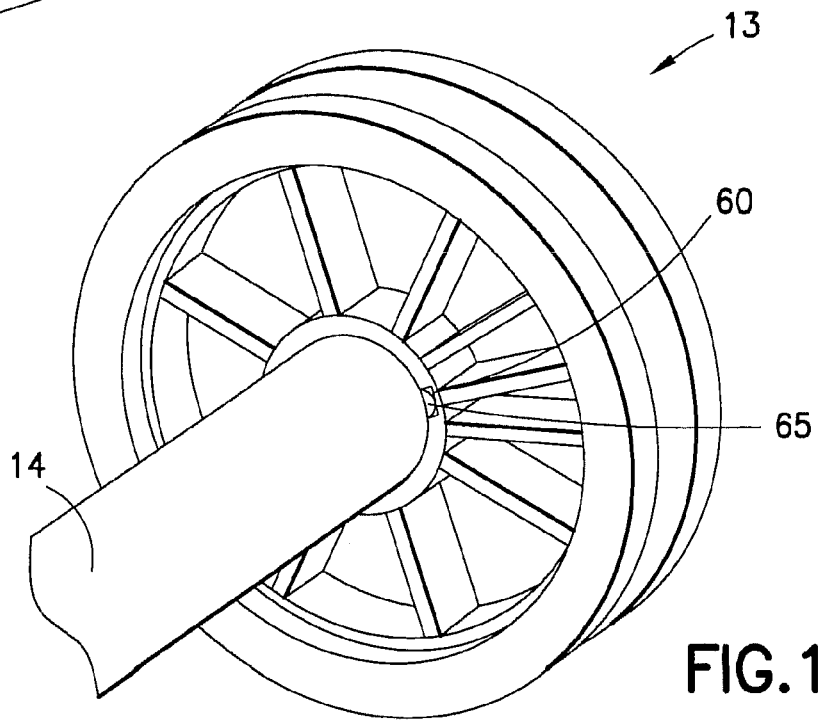
FIG. 13 is the assembly disc and tubular frame member of FIG. 12 in the assembled position.

The tubular frame members 14 (FIGS. 17-18) are inter-fitted and then passed through canvas support opening 221, and then forced-filled into the circular hub 222 of discs 13 (FIGS. 1, 12-13). Similarly, the tubular inter-fitting of lower support member 97 with and between upper assembly 15 and lower assembly 16 is likewise readily accomplished. Stabilizer bars 19 are also readily clipped onto stabilizer pin 19*a*, to stabilize the assembled double-decker cot.

Figure 4:
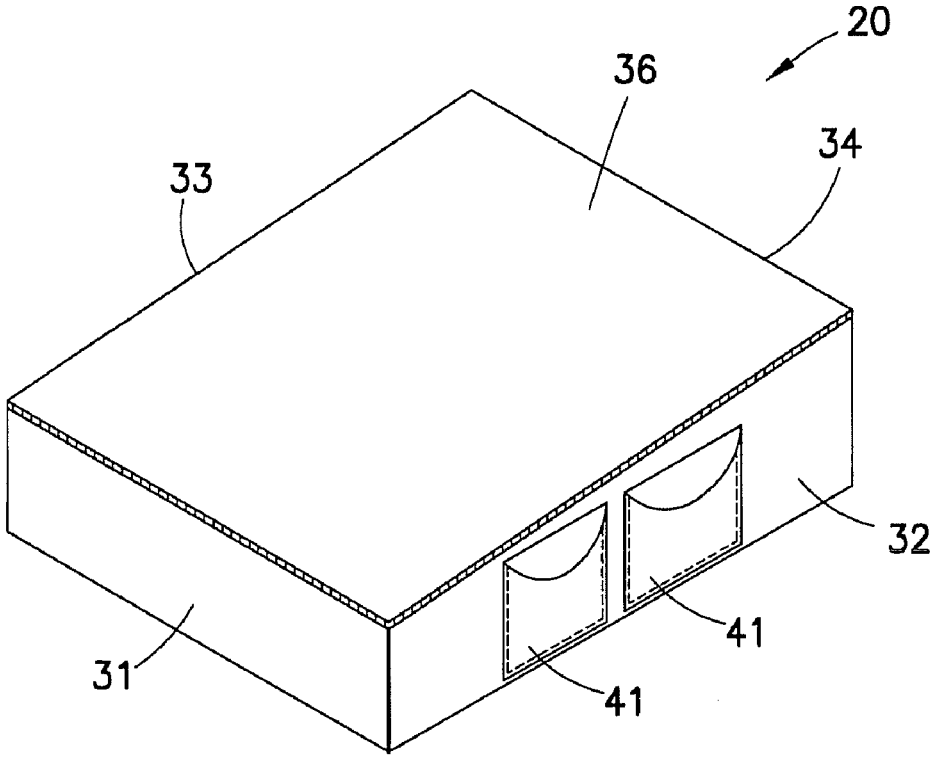
FIG. 4 is a front perspective view of one foot locker in the closed position.
Figure 5:
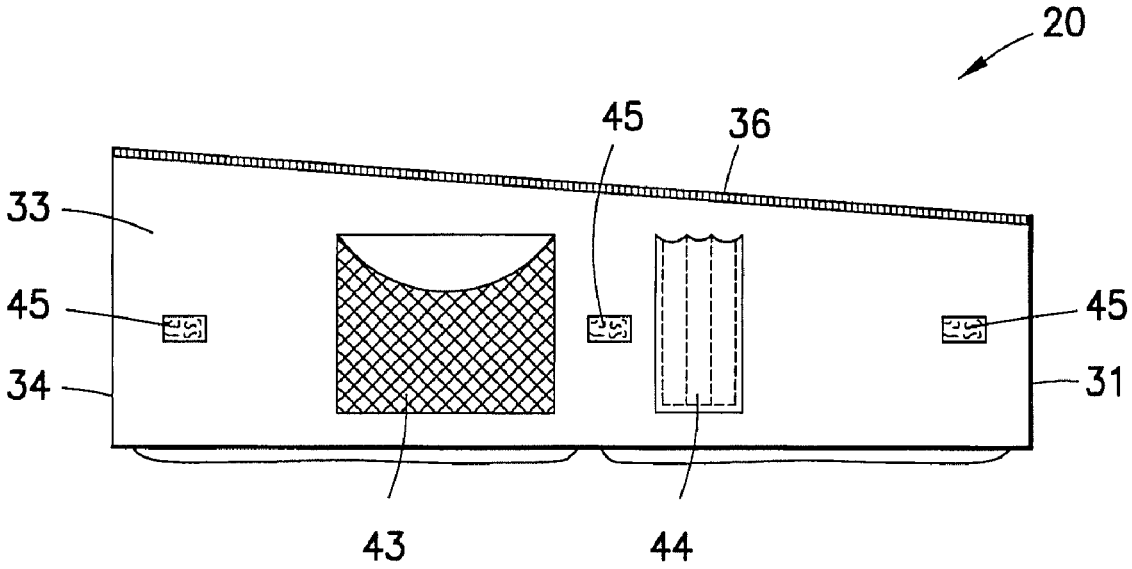
FIG. 5 is a side elevational view of the foot locker as shown in FIG. 4.
Figure 6:
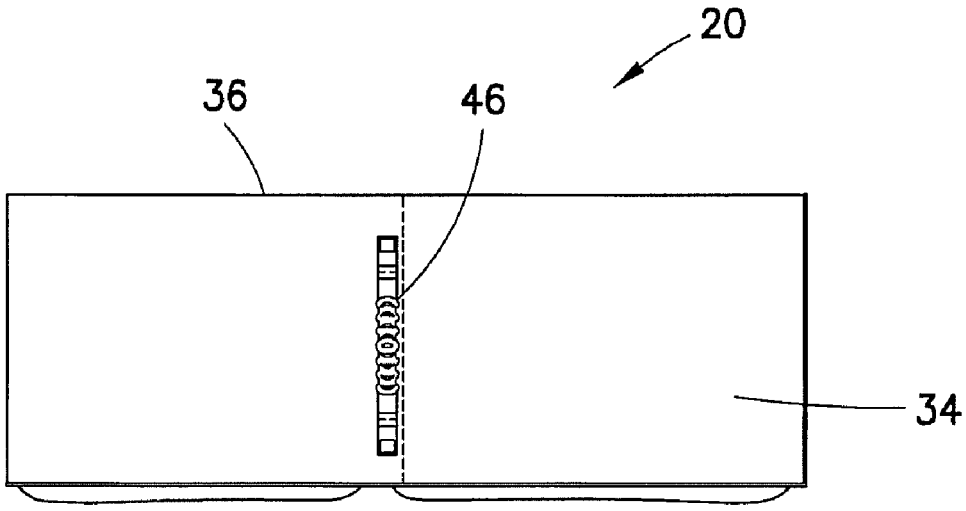
FIG. 6 is a rear elevational view of the foot locker of FIG. 4.
Figure 7:
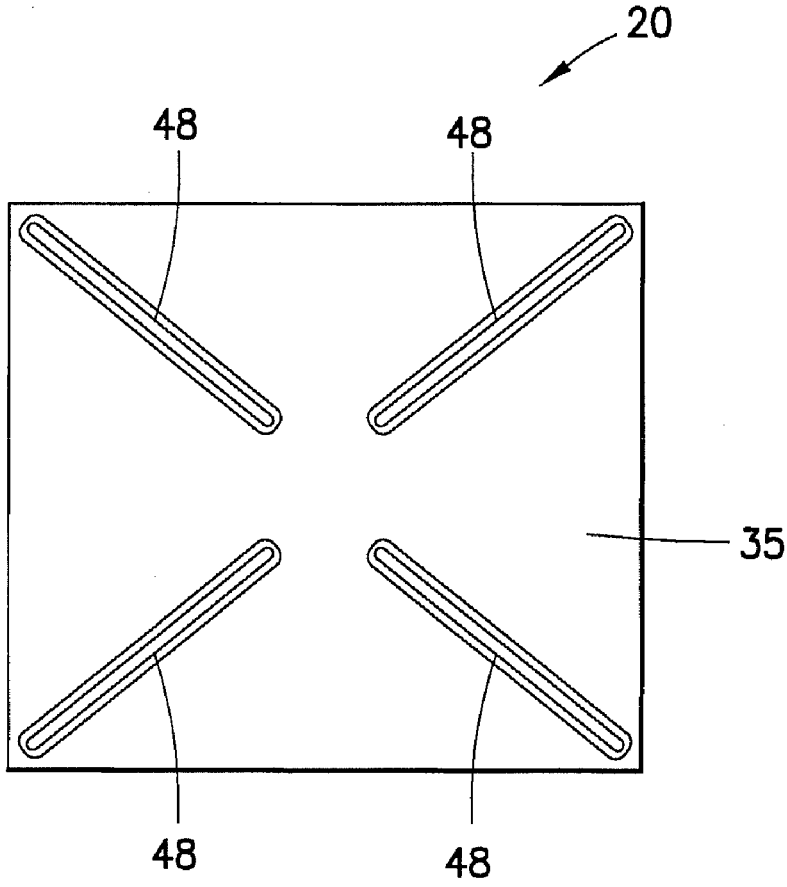
FIG. 7 is a bottom plan view of the foot locker of FIG. 4.
Figure 8:
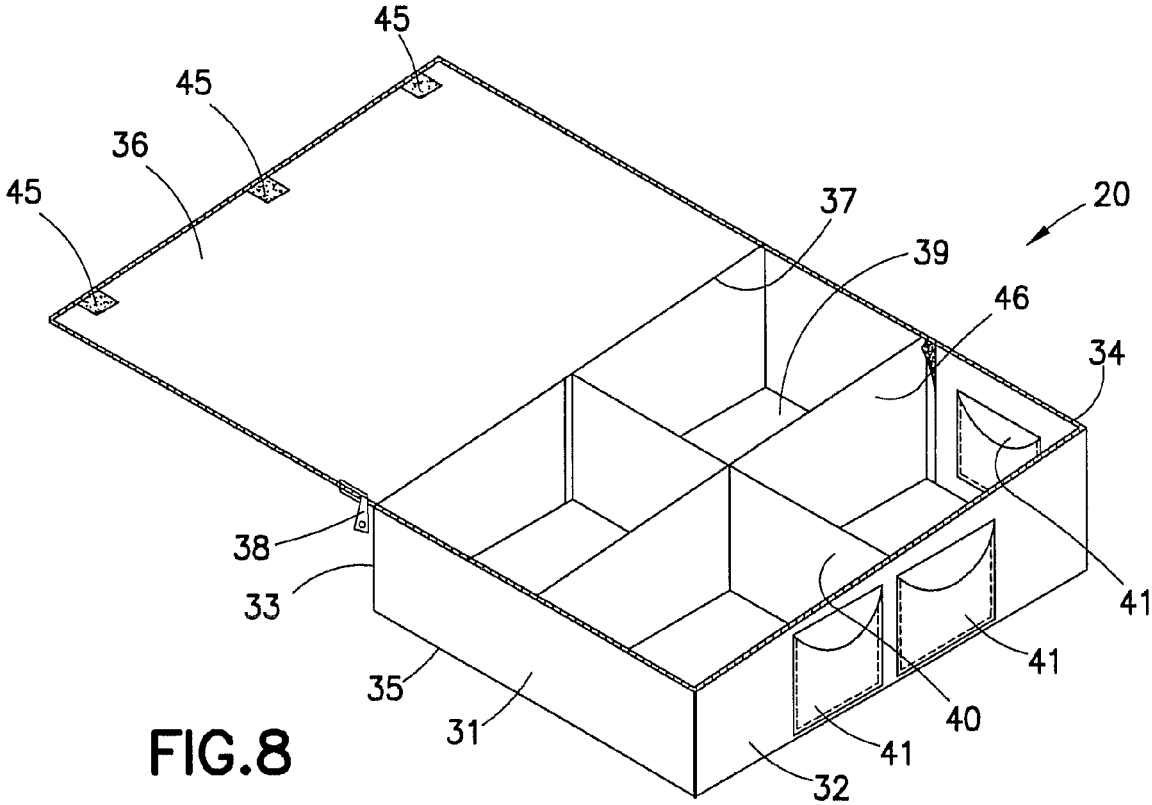
FIG. 8 is a front perspective view of the foot locker of FIG. 4 in the open position showing the assembled partitions.
Figure 8A:
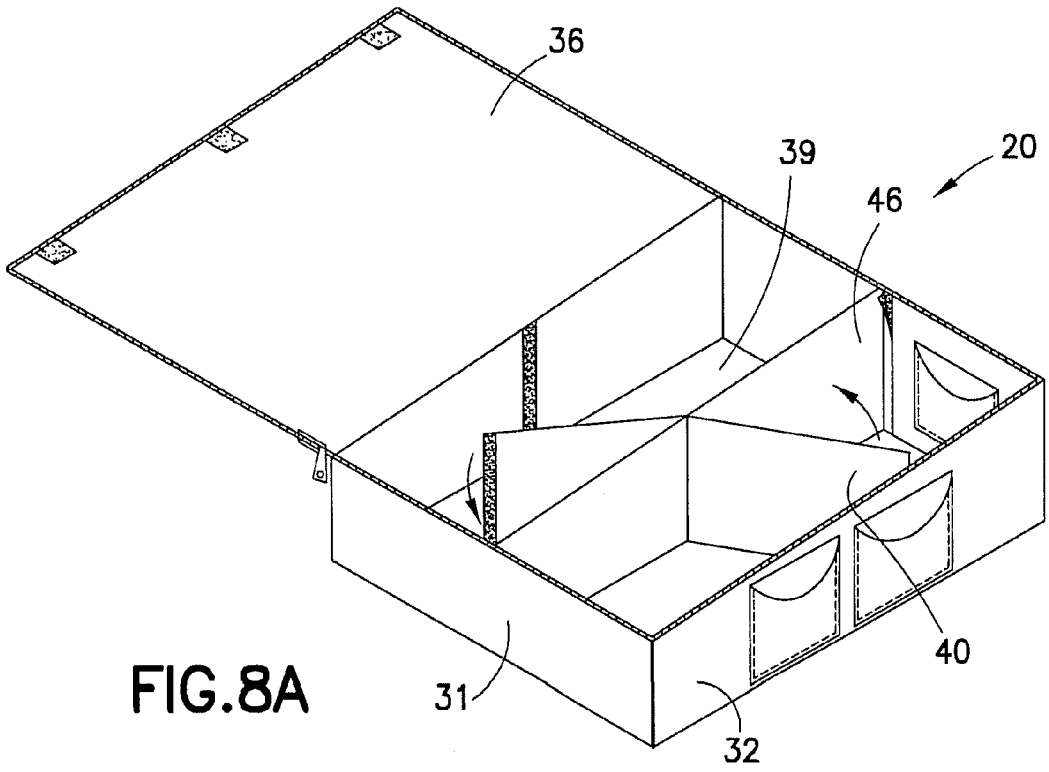
FIG. 8A is the foot locker as shown in FIG. 8 showing the foldable disassembly of the partitions.
Figure 8B:
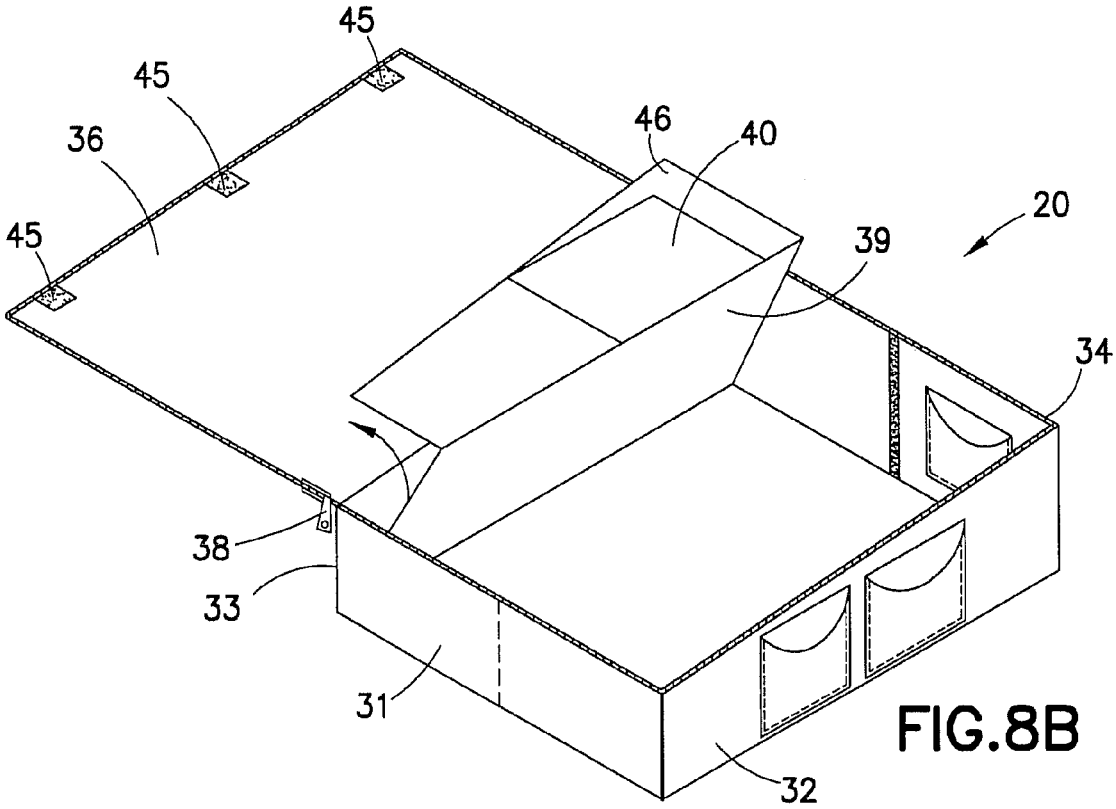
FIG. 8B is the foot locker as shown in FIG. 8 showing the initial foldable disassembly of the foot locker.
Figure 8C:
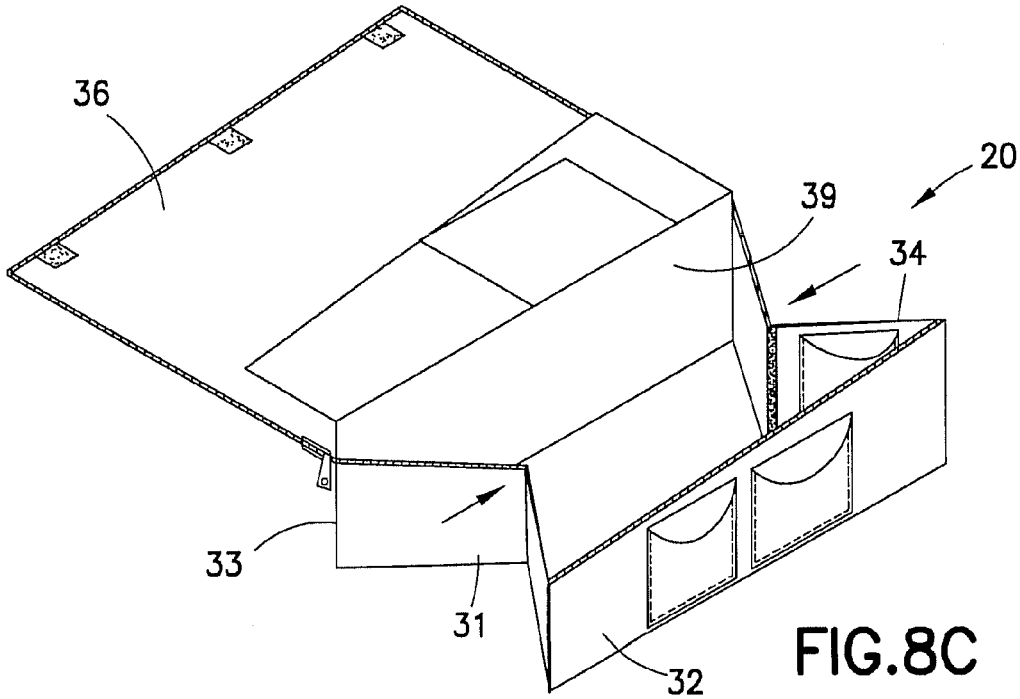
FIG. 8C is the front foot locker as shown in FIG. 8B showing the further foldable disassembly of the foot locker.
Figure 8D:
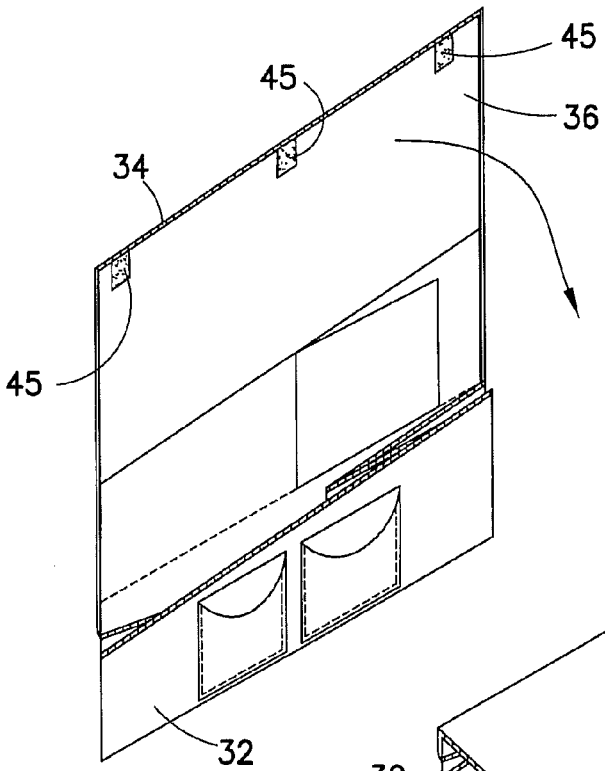
FIG. 8D is the foot locker as shown in FIG. 8C showing the further foldable disassembly.
Figure 8E:
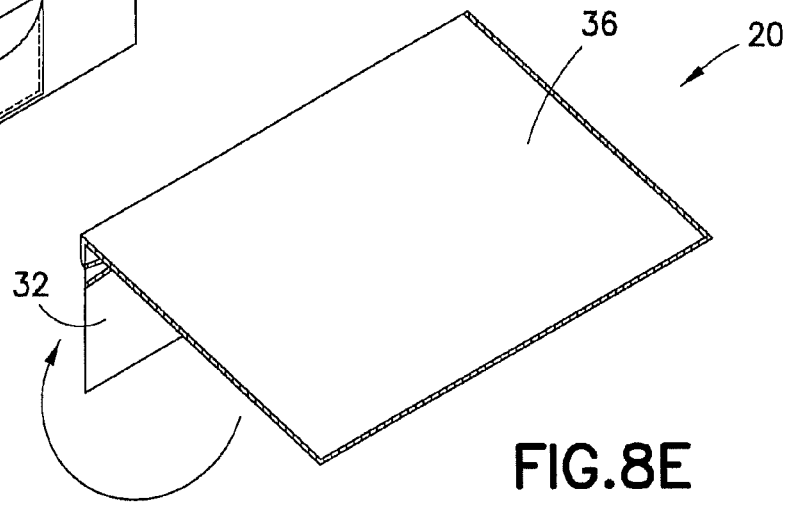
FIG. 8E is the foot locker as shown in FIG. 8D showing the still further foldable disassembly.
Figure 8F:
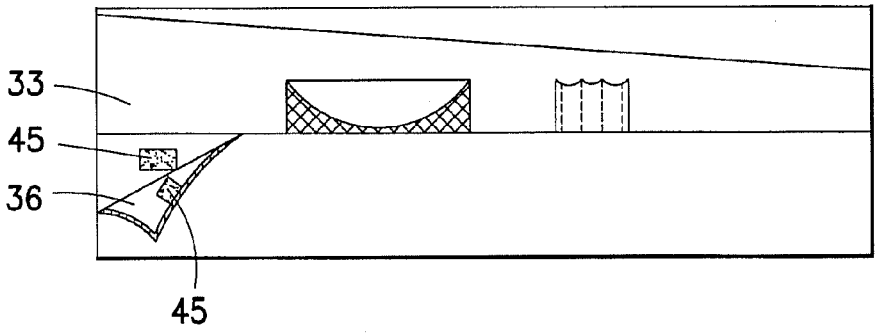
FIG. 8F is the foot locker as shown in FIG. 8E in the fully folded flat disposition.
Figure 9:
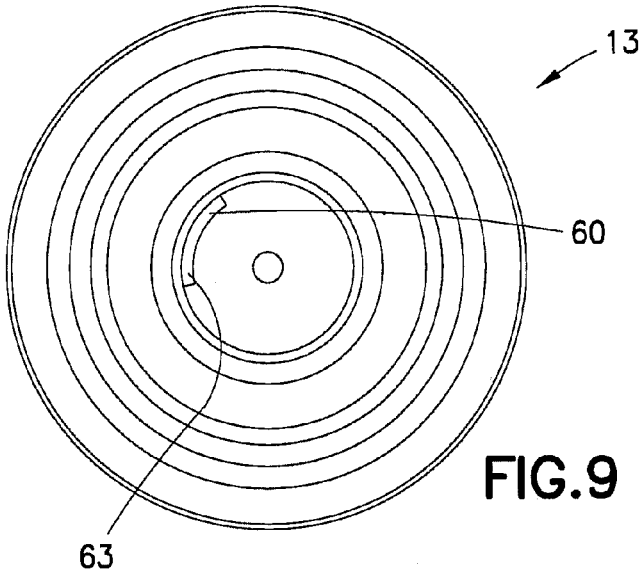
FIG. 9 is a front elevational view of the assembly disc of the present invention.
Figure 10:
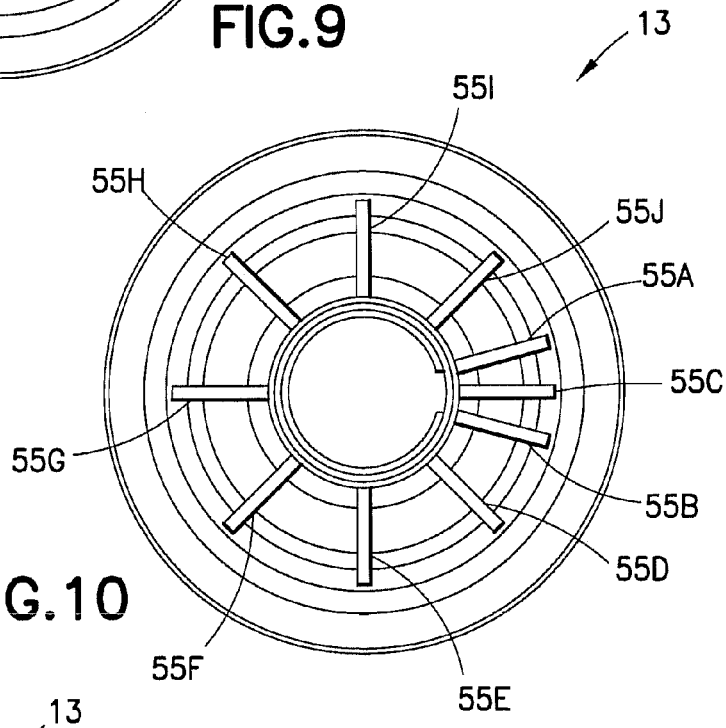
FIG. 10 is a rear elevational view of the assembly disc of FIG. 9.
Figure 11:
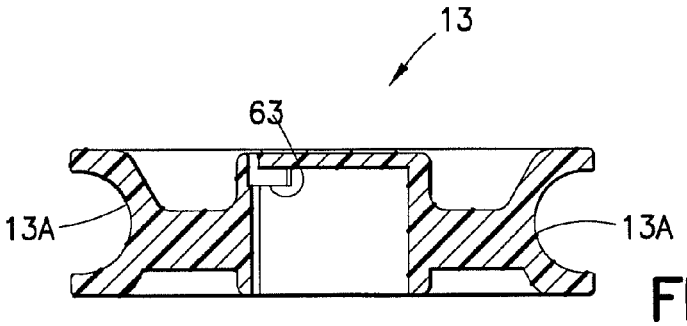
FIG. 11 is a sectional view of the assembly disc of FIG. 9.

Referring to FIGS. 4-7 and 8-8F, there is shown foot locker 20. Foot locker 20 is generally of the flexible material foldable construction. Foot locker 20 includes front 31, sides 32 and 33, rear 34, bottom 39 and openable top 36. Top 36 is hinged to side 33 as at 37. Velcro® pads 45 secure top 36 in the closed position (FIGS. 4 and 8). The inside bottom portion 39 of foot locker 20 includes assembled vertically disposed partitions 46. Partitions 46 are Velcro® pad secured to the inner walls of foot locker 20 (FIG. 8). Partitions 46 are of foldable disassembly construction together with bottom 39 (FIGS. 8A-8C). Flexible material pockets 41 (typical) are fixedly secured or sewn on the outside wall of side 32. Side 33 includes net construction storage pocket 43, elongate item storage pocket 44 and Velcro® pads 45 (typical (FIG. 5). Pads 45 attach to other cooperatively disposed pads such as on a second foot locker or to carry bag pads when in the folded stowed construction for ready transport. Rear 34 includes flexible handle 46 for ready transport of the foot locker 20 with or without its contents (FIG. 6). Bottom surface 35 includes four thermoplastic reinforcing ribs 48 fixedly glued or thermoplastically bonded to bottom surface 35 to support the upright foot locker 20 on a floor surface.

Foot locker 20 is readily folded in a step wise manner to a fully folded flat disposition (FIGS. 8A-8F) for ready for transport in the carry bag, as will be more fully discussed hereinafter.

The First Disc and Elongate Support Embodiment

Figure 14:
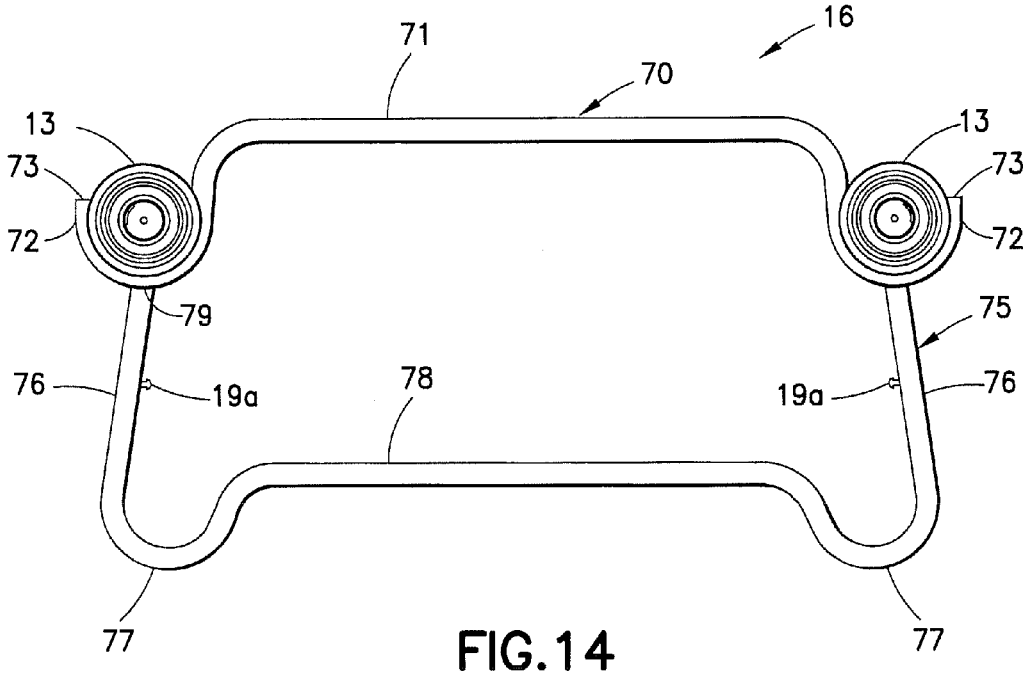
FIG. 14 is an outer side elevational view of the frame member and disc construction of the lower bed.
Figure 15:
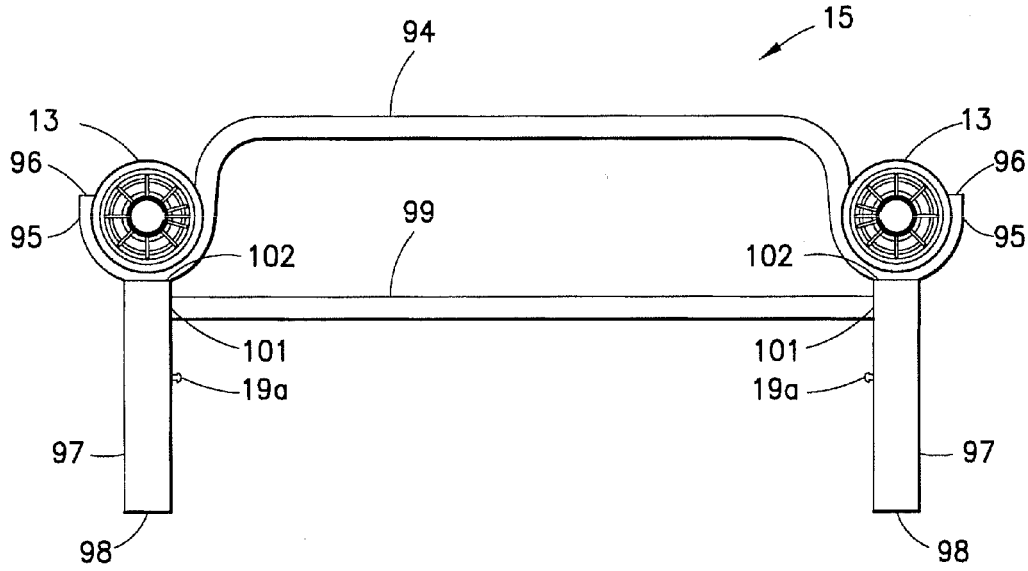
FIG. 15 is an inner side elevational view of the frame member and disc construction of the upper bed.
Figure 16:
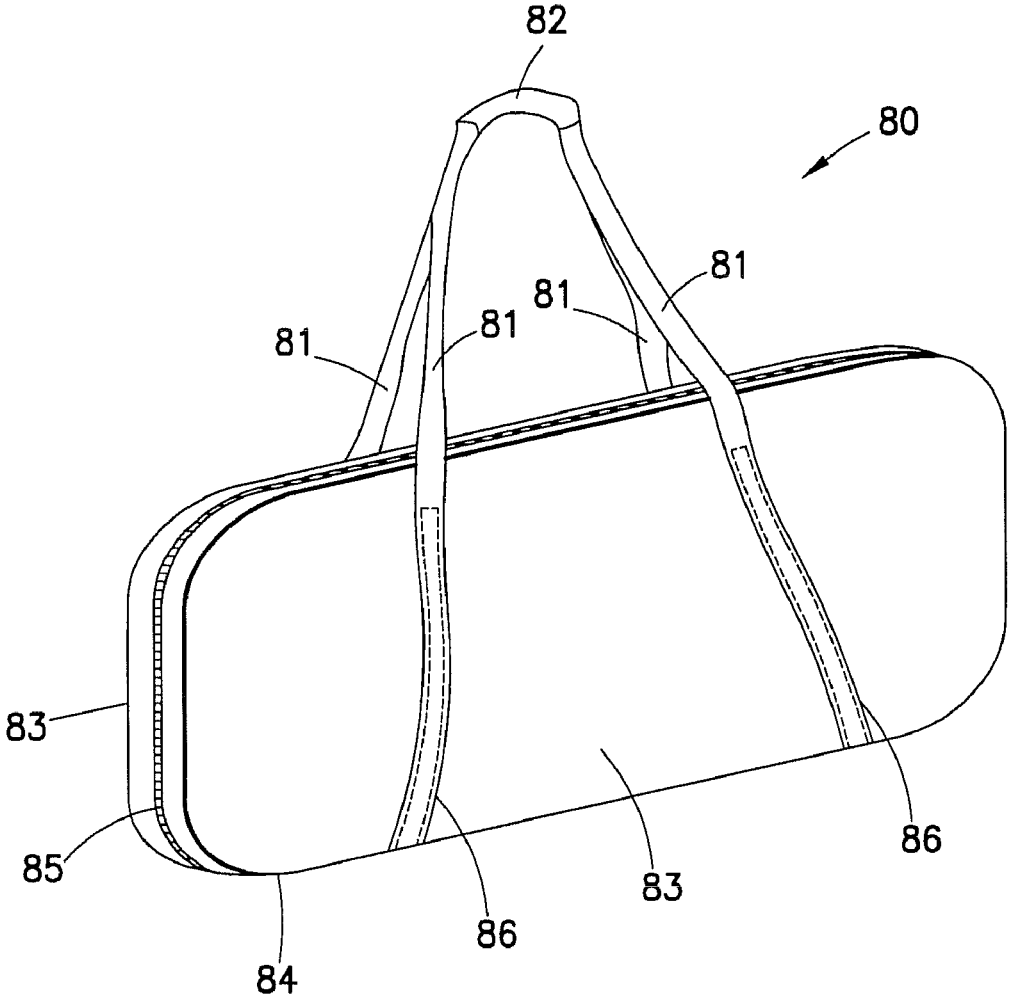
FIG. 16 is a front perspective view of one of the two carry cases in the closed position.

Referring to FIGS. 9-13, there is shown assembly disc 13, including central hub 222, peripheral concave seat 13A, and a plurality of ribs 55A-55J. Ribs 55A-55J are asymmetrically disposed. Ribs 55A and 55B are immediately oppositely juxtaposed to one rib 55C. Ribs 55A-55B are not radially disposed. Ribs 55C-55J are symmetrically radially disposed. The specific asymmetrical construction 55A-55B is juxtaposed to and straddles partial circumferential slot 60. Slot 60 is sized to receive locking cam or wing 65 of tubular member or assembly 14. In this manner of construction, tubular elongate support or member wing 65 engages slot 60 and is rotated in race 63 to a locked position. The asymmetrical rib construction 55A-55C maintains the integrity and operability of the interconnected metal tubular member 14/wing 65 disposed in thermoplastic disc slot 60/race 63 construction, as well as providing durability in heavy duty use. Tubular elongate support or member 14 is preferably formed of two inter-fitted swaged tubular frame members for improved support strength in heavy duty environments. The foregoing constructions are particularly useful in military environments Referring to FIGS. 14-15, there is shown the pre-assembled foot assembly 16 (FIG. 14) and pre-assembled head assembly 15 (FIG. 15). Foot assembly 16 includes integral tubular assemblies 70 and 75 and two inter-fitted discs 13. Tubular assembly 70 is formed of a horizontally disposed cross member 71 with semi-circular portions or wings 72 having circular ends 73. Tubular foot support 75 includes downwardly outwardly disposed legs 76 with curvilinear tubular feet 77 and bottom tubular cross piece 78 of integral construction. Tubular foot support 75 is integrally bonded or welded to tubular assembly at 79. A pair of stabilizer pins 19*a* for connection to stabilizers 19 (FIG. 1). Disc 13 and particularly annular circumferential recessed seats or tracks 13A are force fitted into wings 72. Disc 13 as assembled to integral assemblies 70 and 75 forms foot assembly 16. Foot assembly 16 as shown in FIG. 14 is readily stowed in a carry case.

Referring specifically to FIG. 15, there is shown head assembly 15. Head assembly 15 includes tubular cross member 94 with outwardly dispose semi-circular wings 95 having circular ends 96, and downwardly vertically disposed rectilinear tubular members 97 terminating in rectilinear end 98. A cross-piece 99 interconnects and braces members 97. Stabilizer pieces 19*a* are disposed at one end on member 97. Foot pads 210 (FIG. 3) are clipped onto ends 98 of members 97 to provide a protective bearing surface for the floor. Head assembly 15 is of integral bonded or welded construction as at 101 and 102. Disc 13 is force fitted onto semi-circular ends 95, in a manner similar to that for foot assembly 16. Head assembly 15 as shown in FIG. 15 is readily stowed in a carry case.

Figure 17:
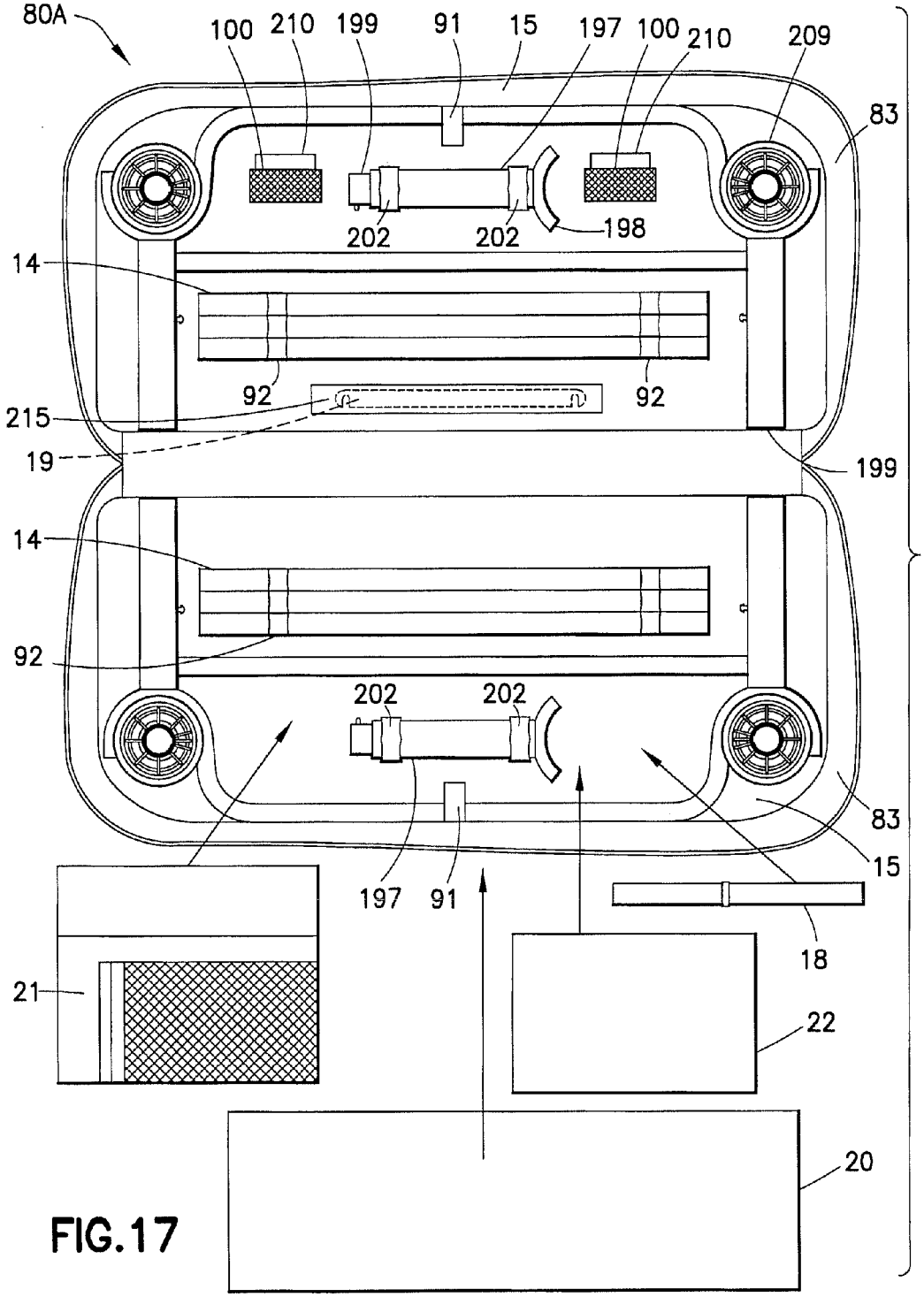
FIG. 17 is a plan view of one carry case in the open position principally showing the upper bed assembly construction.

Referring to FIG. 17, there is shown carry case 80. Carry case 80 is formed of flexible material or fabric. Case 80 includes straps 81 and handle 82. Carry case 80 includes panels or sides 83, hinge 84 and zipper 85 which selectively encloses sides 83. Straps 81 are stitched or bonded to sides 83 as at 86. Carry case 80 is provided in two embodiments 80A and 80B, respectively, for the head assemblies (FIG. 17) and foot assemblies 16 (FIG. 18) as well cooperating construction elements. In this manner of construction, the two carry cases 80A and 80B contain all the construction components and elements required to assemble the double-decker bed or cot 10. A person of average strength can readily transport both fully complemented carry cases 80A and 80B to a location and readily assemble the double-decker cot 10.

Referring specifically to FIG. 17, there is shown carry case 80A. Carry case 80A contains two head assemblies 15, held in place by Velcro® tab straps 91. A plurality of inter-fitting tubular members 14 are retained in place on the inside of panel 83 by straps 92. Lower support members 197 include part-circular tubular end piece 198 for engaging disc 13 as at 201. Members 197 are held in place by retainers 202.

Netted pockets 100 are fixedly secured to the inside of carry case panel 83. Rectilinear plastic footings 210 are held in net pockets 100. Footings 210 frictionally fit onto tubular member 97 at 199 when the upper bed is utilized as a singled bed in contradistinction to the double-decker construction. A plurality of stabilizer bars 19 are retained in elongate pocket or sleeve 215.

The folded accessories bag 21 is stowed between the folded case panels 83. The folded foot locker 20 is stowed between the folded case panels 83. The integrating or locking strap 18 is also stowed between the folded case panels 83.

Figure 18:
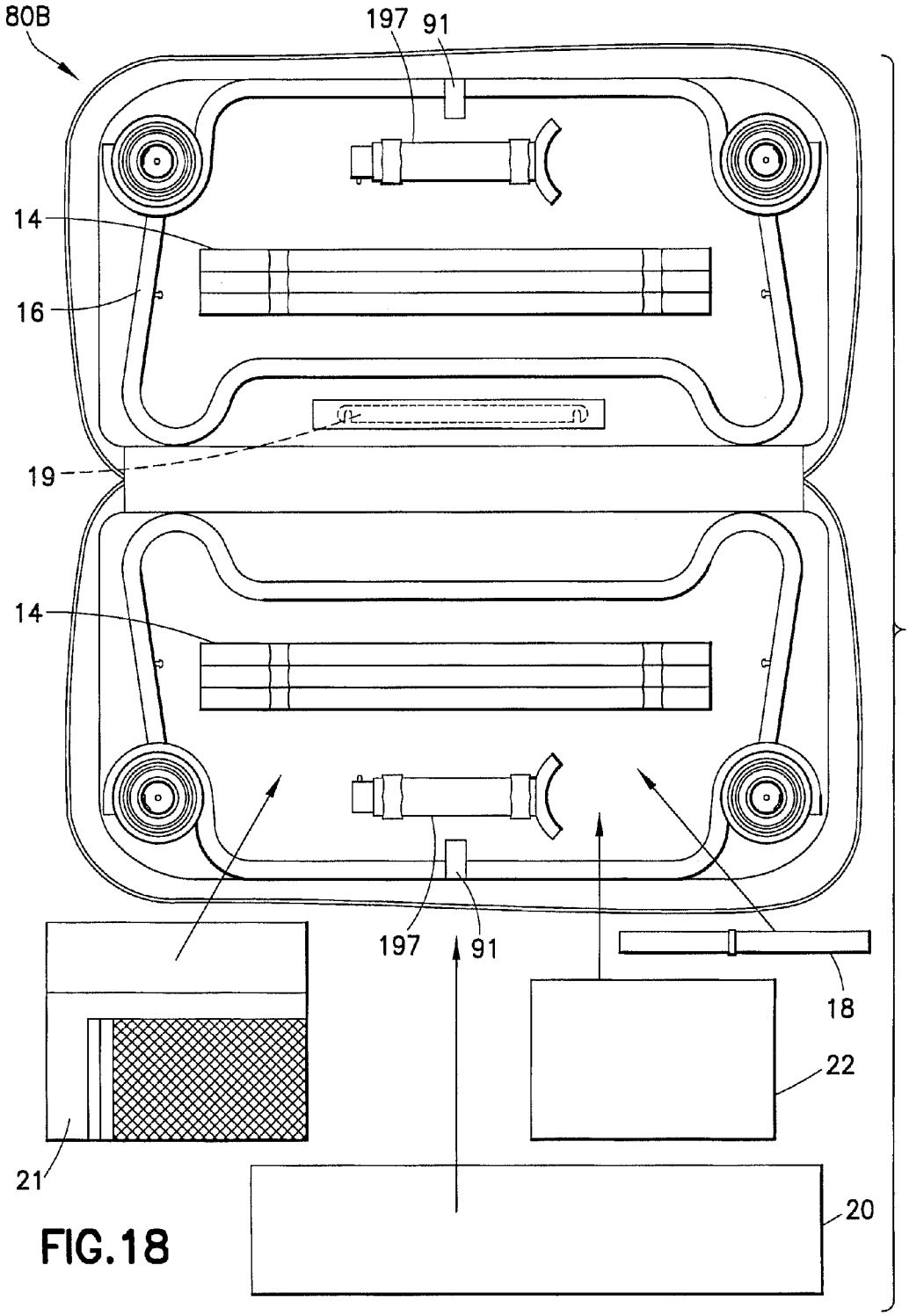
FIG. 18 is a plan view of the other carry case in the open position principally showing the lower bed assembly construction.

Referring to FIG. 18, there is shown carry case 80B. Carry case 80B is similar in overall construction to carry case 80A. However, carry case 80B retains the foot assemblies 16. The assemblies 16 are retained by means of Velcro® straps or tabs 91. Carry case 80B in a like manner to carry case 80A contains lower support members 197, an accessories pocket 21, a foot locker 20 and an integrating or locking strap 18.

The Second Disc and Elongate Support Embodiment

Referring to FIGS. 19-27A, there is shown a second embodiment of a portable bed assembly 300. The second embodiment in general, includes disc 310, elongate support 320 and locking construction 330.

Figure 23:
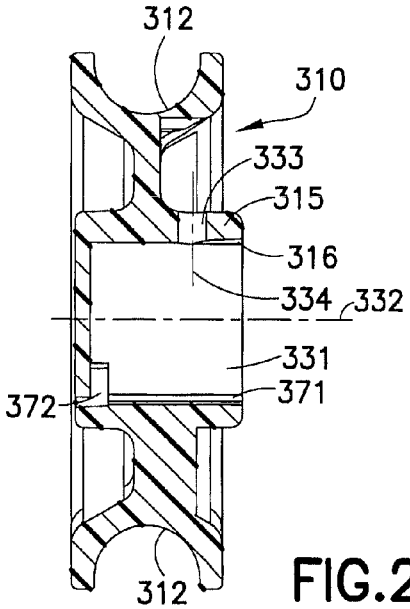
FIG. 23 is a sectional view taken along the line 23-23 of FIG. 22.

Disc 310 has a body 311 having a central hub 315, and a central hole 331 having a centerline or axis 332. Disc body 311 is formed with a peripheral groove 312 for receiving a curvilinear support (not shown) in the manner discussed with respect to the first embodiment. Disc body is formed with a plurality of symmetrically disposed ribs 313 (typical), and asymmetrically disposed ribs 313*a*, 313*b* and 313*c*. Hub 315 has a tapered groove 316 extending rearwardly or inwardly from the front of disc body 311. A transversely disposed through hole 333 is formed in hub 315. Through hole 333 has a centerline or axis 334 which is perpendicularly disposed to central hole axis 332 (FIG. 23). Through hole 333 is congruent with rearwardly tapered groove 316 for purposes hereinafter appearing. A clearance groove 380 is formed in the disc body 311 to permit removal of a mold core (not shown) which is used in the formation of transversely disposed through hole 333. Disc 310 is formed or of molded durable thermoplastic or thermoset material and construction by means well known in the art. The mold core (not shown) may be a multiple component for molding the disc as is well known in the molding art and within the contemplation of the present invention.

Figure 19:
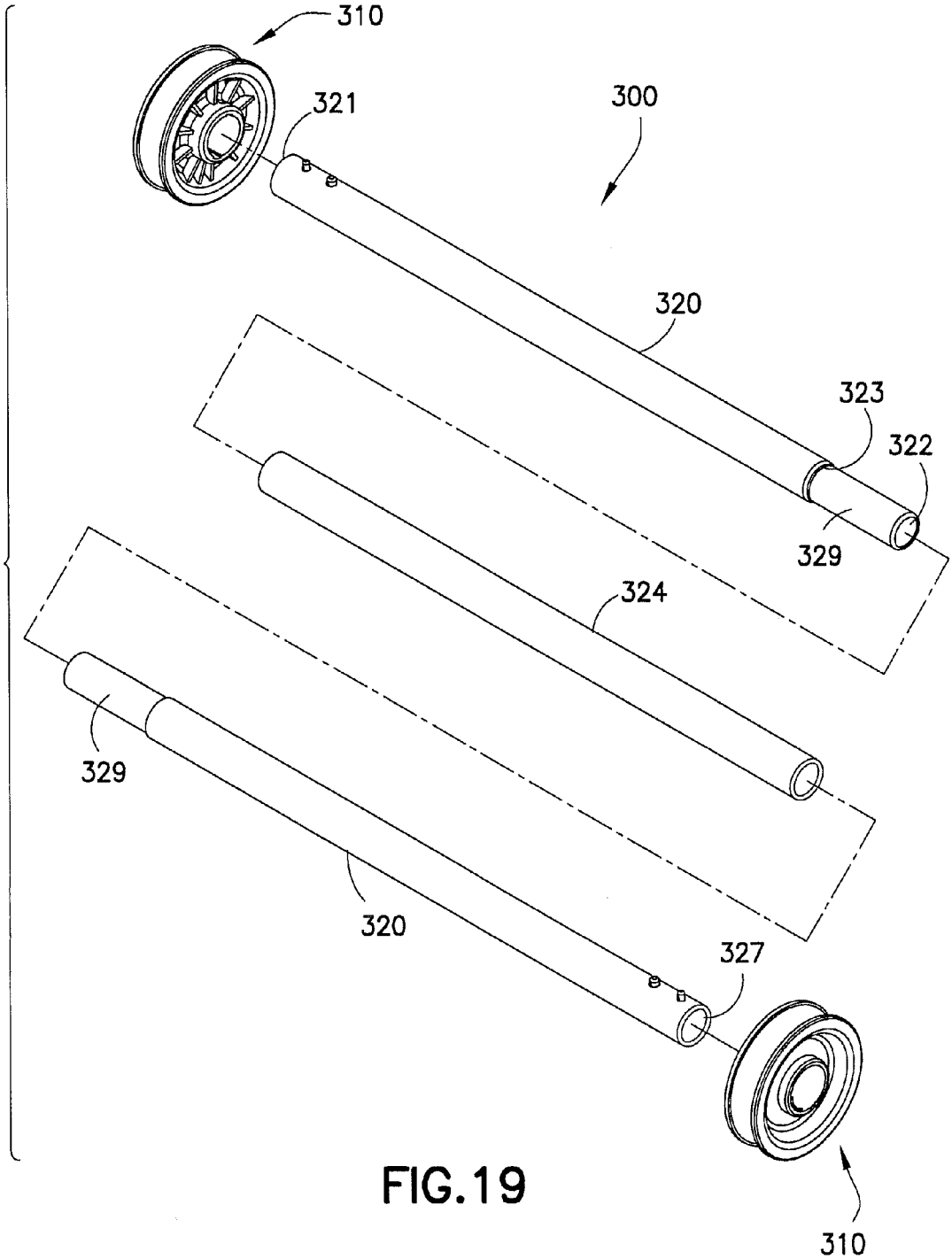
FIG. 19 is a an exploded assembly view of the portable bed assembly of the second embodiment.
Figure 20:
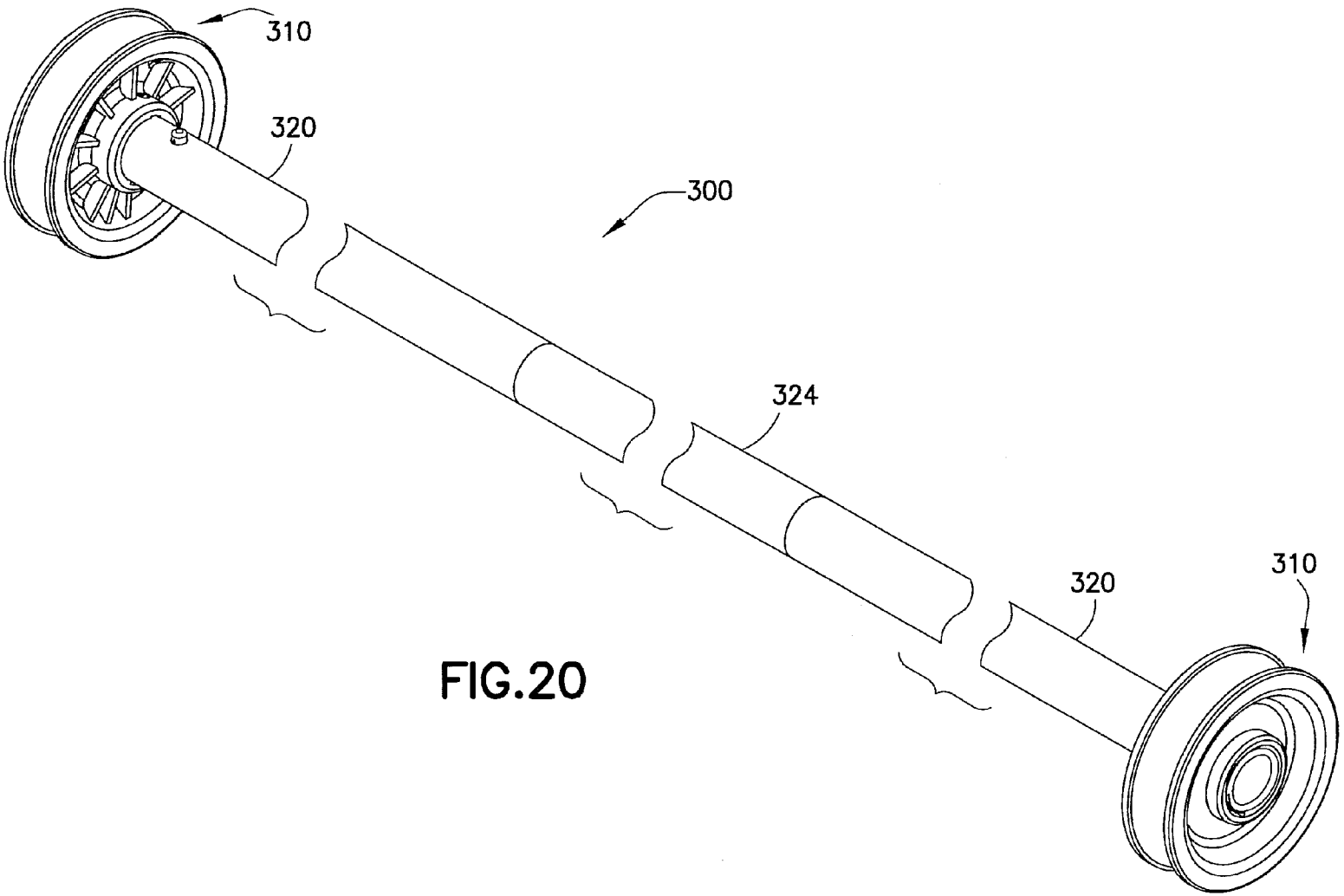
FIG. 20 is a fragmented perspective view of the assembled portable bed assembly of FIG. 19.
Figure 21:
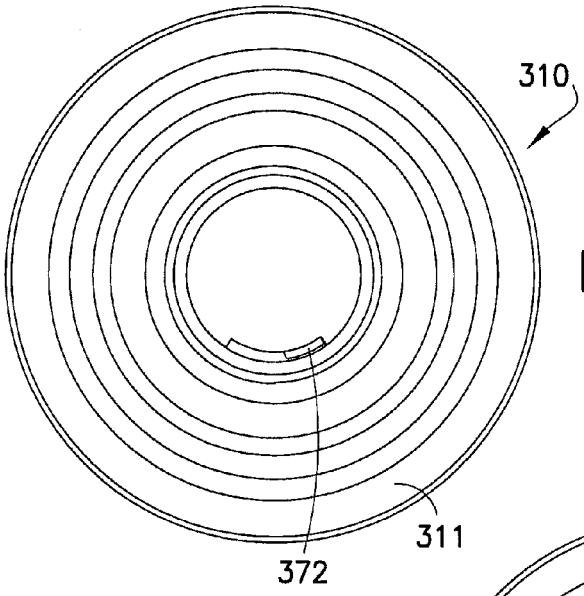
FIG. 21 is a rear elevational view of the disc of the second embodiment.
Figure 22:
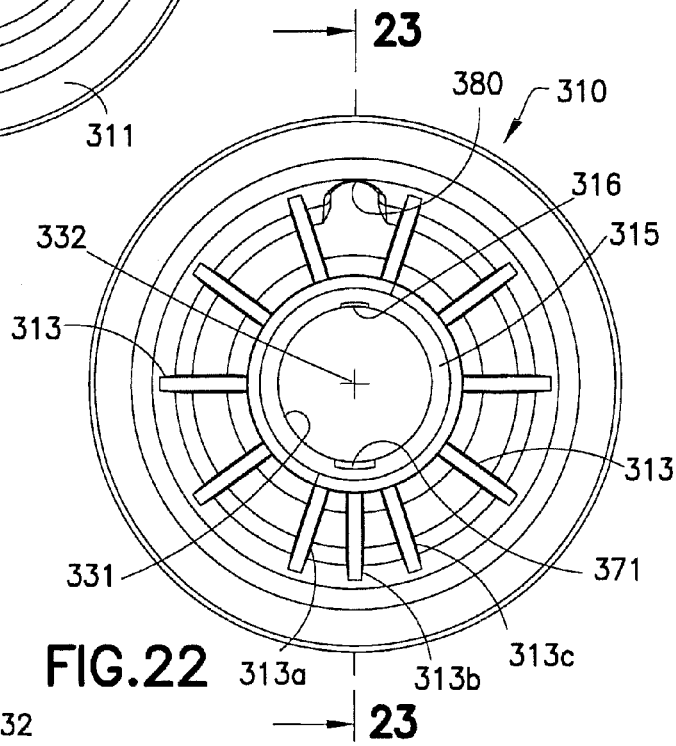
FIG. 22 is a front elevational view of the disc of FIG. 21.

Elongate support 320 is a tubular member having open ends 321 and 322. Two aligned holes 323 and 324 are formed in support 320 adjacent end 321 for purposes hereinafter appearing. End 322 is swaged as at 329 and includes annular lip 323. An intermediate elongate support 324 frictionally inter fits swaged portion 329 and abuts lip 323. The one-side portable bed support assembly 300 includes two discs 310, two elongate end supports 320, and an intermediate elongate support 324 (FIGS. 19 and 20).

Figure 24:
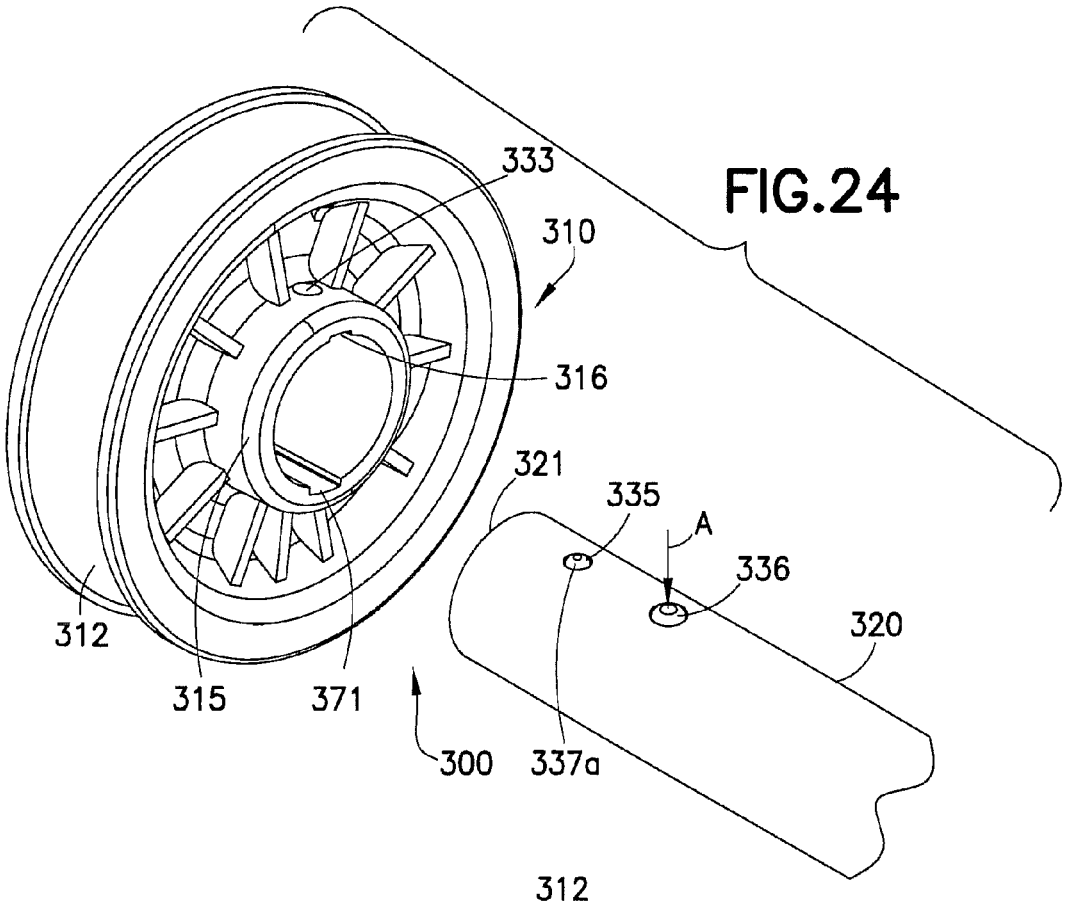
FIG. 24 is an enlarged perspective assembly view of the elongate support engaging the front of the disc as in FIG. 19.
Figure 25:
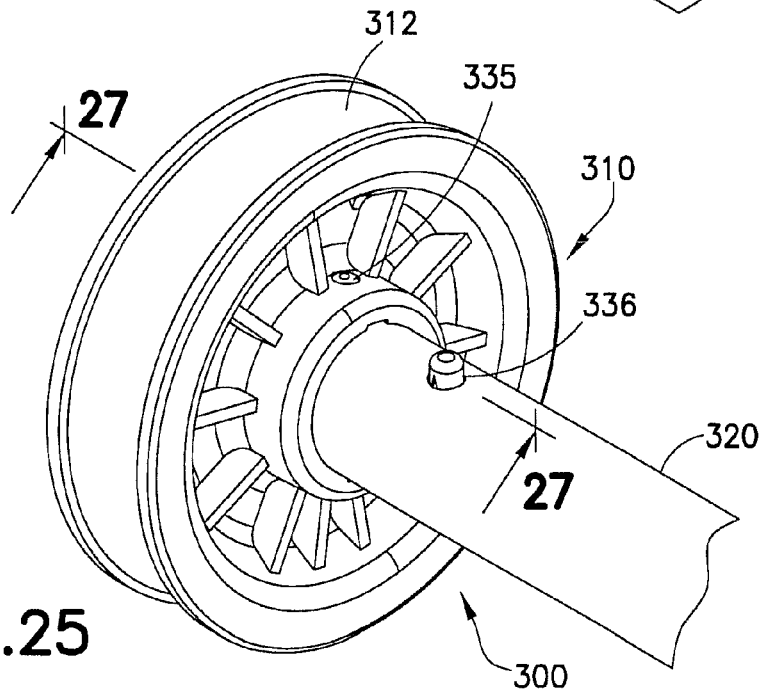
FIG. 25 is a perspective view of the assembly on FIG. 24 shown in the assembled locked position.
Figure 27A:
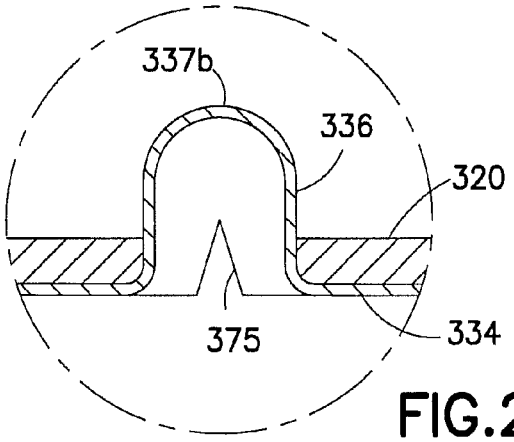
FIG. 27A is an enlarged sectional view of lined section 27A of FIG. 27.
Figure 26:
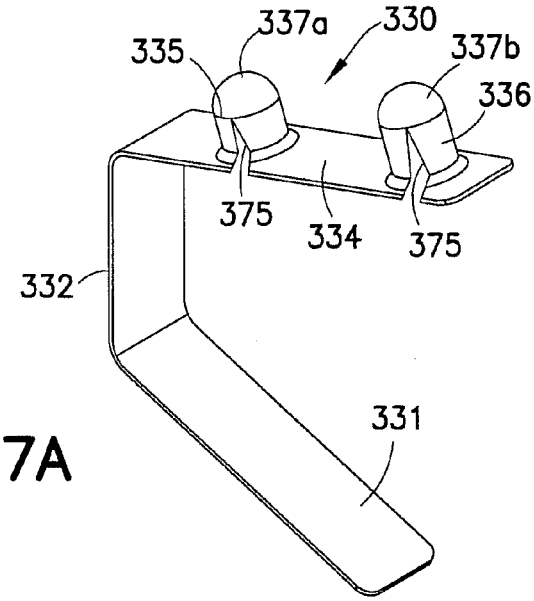
FIG. 26 is an enlarged perspective view of the locking member.
Figure 27:
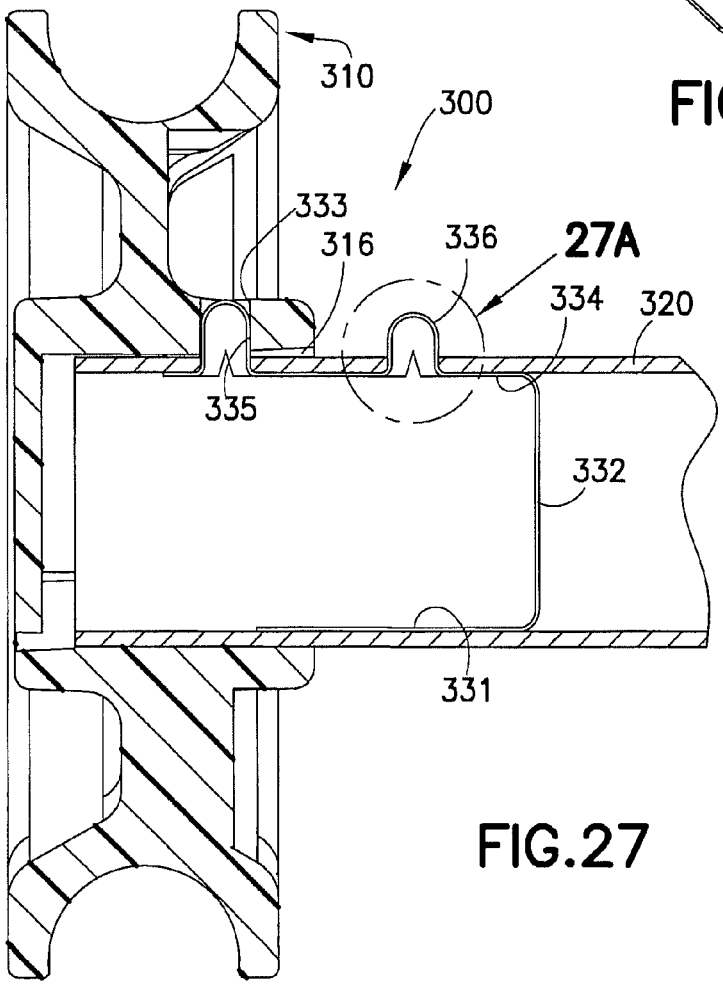
FIG. 27 is an enlarged sectional view taken along the line 27-27 of FIG. 25.

Referring now to FIGS. 26-27A, there is shown locking construction or member 330. Member 330 is preferably a unitary one-piece flexible construction, particularly a one-piece sheet metal or leaf spring construction. Member 330 includes a U-shaped portion having a lower flex leg 331, transverse portion 332 and an upper flex leg 334. A pair of pins, namely lock pin 335 and second pin 336 are formed from and extend upwardly from upper flex leg 334. Pins 335, 336 are formed with rounded tops 337*a* and 337*b*. Pin 336 is more elongate than pin 335. The pins 335, 336 have flex relief inverted V-grooves 375 (typical). In this manner of construction, member 330 is flexibly inserted into elongate support end 322 so as to flexibly pressingly engage the inside surface of elongate support 320, with pins 335, 336 slidably received in holes 323,324, respectively so as to extend radially outwardly adjacent elongate support end 321. In the aforesaid manner of construction, elongate support 320 with assembled retained locking member 330 is facingly disposed to the front of disc 310 (FIG. 24). The user then depresses second pin 336, as shown by arrow A in FIG. 24. This depression of second pin 336 in turn causes the retraction of lock pin 335 into elongate member 320, with rounded top 337*a* exposed. Top 337*a* is aligned with groove 316, and the elongate support 320 by pin to 337*a* is slidably guidedly received in groove 316 (FIG. 25). The lock pin 335 is thereby aligned with transversely disposed hole 333. The user then releases second pin 336, so that second pin 336 and in turn lock pin 335 extend radially outwardly, with lock pin 335 seated in hole 333. The elongate support 320 is thereby non-rotatably locked in disc 310.

Disc 310 further includes congruent grooves 371 and 372 (FIG. 23) for rotatably receiving and locking the first embodiment elongate support in the manner as previously described in connection with the first disc and elongate support embodiment. That is, disc 310 is alternatively operable with the first and second embodiment elongate supports.

The Third Disc and Elongate Support Embodiment

Figure 28:
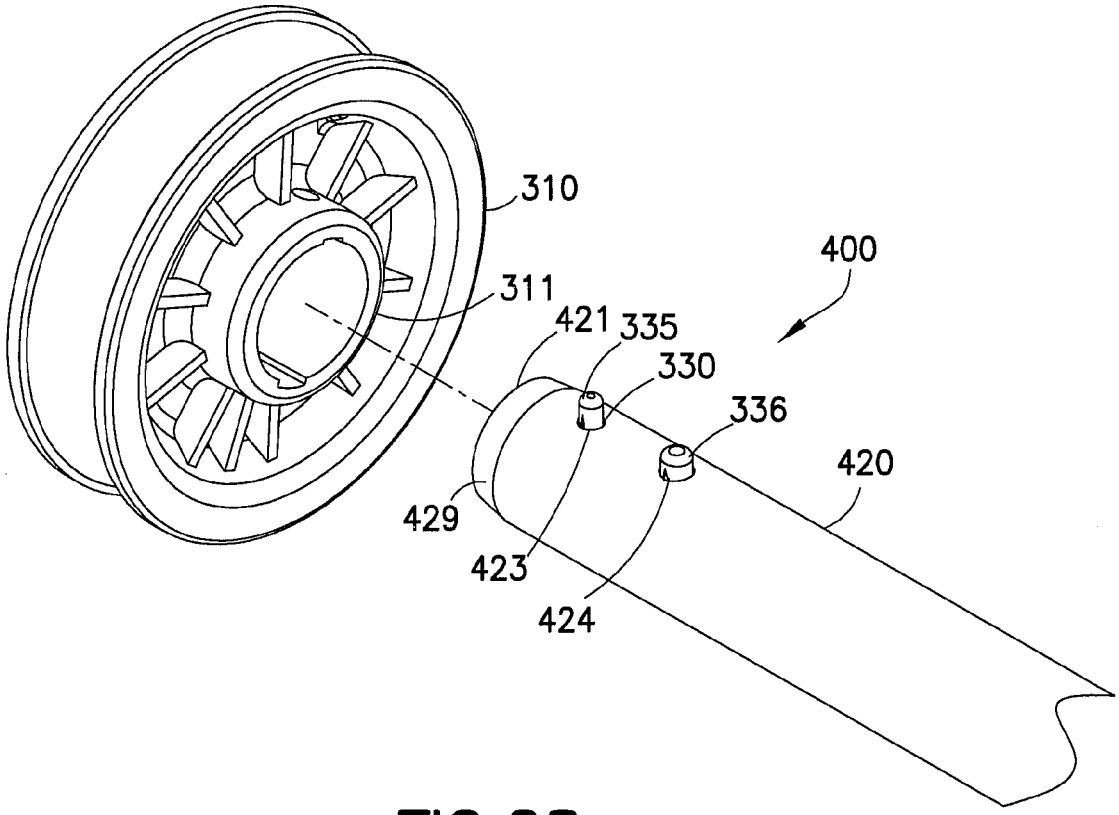
FIG. 28 is an assembly view as in FIG. 24 with a modified construction elongate support.

Referring to FIG. 28, there is shown a second embodiment of a portable bed assembly 400. The second embodiment in general, includes disc 310, modified elongate support 420 and locking construction 330.

Elongate support 420 is a tubular member has open end 421. Two aligned through holes 423 and 424 are formed in support 420 adjacent end 421 for purposes hereinafter appearing. End 421 is swaged as at 429 in this third embodiment for improved guidance and inter fit with disc body 311. This provides a quick positive locking action.

Lock pin 335 and second pin 336 extend upwardly from elongate support 420 and are operable in the manner described in the previous embodiments.

The present invention thereby provides a disc construction, and particularly a disc and elongate support assembly, wherein the elongate support is locked in the disc in one of the two modes or dispositions, wherein the second embodiment disposition the elongate support is non-rotatably locked in the disc body, and in the first embodiment disposition the elongate support is rotatably locked in the disc body.

In the afore-discussed construction, two essentially uniform construction carrying cases 80A and 80B effectively stow all the components for assembling a double-decker bed or two separate single beds. Canvas bed supports 22 may be separately transported or provided, as these may need to be periodically washed or replaced with extended use.

In the afore-described construction, a double-decker bed or two separate single beds can be readily assembled and disassembled. While the foregoing describes a construction assembly for one double-decker bed or two single beds, it is within the contemplation of the present invention to provide further expanded construction assemblies such as for a triple-decker bed.

The foregoing description is intended to be merely illustrative and not limiting of the invention, which invention is defined by the adjoined claims.

What is claimed is:

1. A portable bed assembly comprising:

an elongate bed support, a disc for assembly with the elongate support, said disc comprises a body having a central hole and a transversely disposed hole, said disc and elongate support comprise cooperable means for locking the elongate support in the disc body, said means for locking the elongate support in the disc comprises a retractably extendable lock pin, and further comprises means for extending the retracted lock pin radially outwardly, wherein with the retracted lock pin aligned with the transversely disposed hole, and the elongated support slidably disposed in the central hole whereby the extended lock pin is disposed in the transversely disposed hole, the elongate support is non rotatably locked in the disc body, said means for locking the elongate support in the disc body comprises a unitary construction, said unitary construction comprises the lock pin and a U-shaped flexible portion, and the U-shaped flexible portion is disposed in the elongate support.

2. The assembly of claim 1, said unitary construction further comprises a second retractably extendible pin operably disposed with the elongate support, whereby with depression of the second pin, the lock pin is depressed and aligned with the transversely disposed hole and with release of the second pin the lock pin is disposed in the transversely disposed hole to non-rotatably lock the elongate support in the disc.

3. A lock pin construction for connecting bed support members and slidably engaging a bed support disc in a portable bed assembly comprising:

an elongate tubular portable bed support, said elongate support comprises a first end and a second end, and having two holes disposed adjacent the first end;

a locking member disposed in the support adjacent the first end, said locking member comprises a lock pin and a second pin, said lock pin extends outwardly from the tubular portable bed support, and said lock pin comprises a convex head for slidably engaging a bed support disc groove, each said pin being slidably disposed in a respective hole;

whereby with depression of the second pin the lock pin is depressed and the first end is slidably received in the elongate portable bed support, and with release of the second pin the lock pin extends outwardly so as to be slidably disposed in the support member to lock the elongate support in the member.

4. A lock pin construction for connecting bed support members and slidably engaging a bed support disc in a portable bed assembly comprising:

an elongate tubular portable bed support, said elongate support comprises a first end and a second end, and having two holes disposed adjacent the first end;

a locking member disposed in the support adjacent the first end, said locking member comprises a lock pin and a second pin, said lock pin extends outwardly from the tubular portable bed support, and said lock pin comprises a convex head for slidably engaging a bead support disc groove, each said pin being be slidably disposed in a respective hole;

whereby with depression of the second pin the lock pin is depressed and the first end is slidably received in the elongate portable bed support, and with release of the second pin the lock pin extends outwardly so as to be slidably disposed in the support member to lock the elongate support in the member, and wherein the first end is swaged.

5. A lock pin construction for connecting bed support members and slidably engaging a bed support disc in a portable bed assembly comprising:

an elongate tubular portable bed support, said elongate support comprises a first end and a second end, and having two holes disposed adjacent the first end;

a locking member disposed in the support adjacent the first end, said locking member comprises a lock pin and a second pin, said lock pin extends outwardly from the tubular portable bed support, and said lock pin comprises a convex head for slidably engaging a bed support disc groove, each said pin being slidably disposed in a respective hole;

said upper leg comprises two spacedly disposed grooves, each said pin comprises a groove in communication with a respective upper leg groove;

whereby with depression of the second pin the lock pin is depressed and the first end is slidably received in the elongate portable bed member, and with release of the second pin the lock pin extends outwardly so as to be slidably disposed in the support member to lock the elongate support in the member, said locking member comprises a flexible upper leg, an intermediate U-shaped portion and a lower leg, said pins being disposed on the flexible upper leg.

6. The lock pin construction of claim 5, said locking member comprises a one-piece construction.

7. The lock pin construction of claim 6, each said pin groove comprises an inverted V-groove extending downwardly to the respective upper leg to flexibly pressingly engage the elongate support.

8. The lock pin construction of claim 3, said U-shaped portion being disposed more adjacent the first end than the pins.

9. A lock pin construction for connecting bed support members and slidably engaging a bed support disc in a portable bed assembly comprising:

an elongate tubular portable bed support, said elongate support comprises a first end and a second end, and having two holes disposed adjacent the first end;

a locking member disposed in the support adjacent the first end, said locking member comprises a lock pin and a second pin, said lock pin said lock pin extends outwardly from the tubular portable bed support, and said lock pin comprises a convex head for slidably engaging a bed support disc groove, each said pin being slidably disposed in a respective hole;

said upper leg comprises two spacedly disposed grooves, each said pin comprises a groove in communication with a respective upper leg groove to flexibly pressingly engage the elongate support;

whereby with depression of the second pin the lock pin is depressed and the first end is slidably received in the elongate portable bed member, and with release of the second pin the lock pin extends outwardly so as to be slidably disposed in the support member to lock the elongate support in the member, and slidably engage the bed support disc groove, said locking member further comprises a flexible construction comprising the upper leg pressingly frictionally engaged with the inside surface of the tubular elongate support.

10. The lock pin construction of claim 9, said locking member comprises a one-piece construction.

11. The lock pin construction of claim 10, said one-piece construction comprises a sheet metal construction.

12. In a portable bed assembly combination:

an elongate support being formed with a lock pin immediately adjacent one end of the support; and a disc having an axis and a central hole for assembly with the elongate support, said disc comprising a first groove and a second groove communicating with the first groove, said first grove being in parallel disposition with the axis and said second groove being circumferentially disposed with respect to the axis;

said lock pin being configured to be slidably received in the first groove with insertion of the support into the central hole and then slidably received in the second groove with rotation of the support in the central hole.

13. The combination of claim 12, said second groove comprises a stop, wherein the lock pin abuts the stop after rotation of the elongate support.

14. The combination of claim 12, said disc comprises a one-piece construction, and said elongate support and lock pin comprises a one-piece construction.

15. The combination of claim 13, wherein the second groove subtends an arc.

* * * * *